US006135630A

United States Patent [19]

O'Neill

[11] Patent Number: 6,135,630

[45] Date of Patent: Oct. 24, 2000

[54] MIXER MOUNTING SYSTEM

[75] Inventor: Frank J. O'Neill, Northport, N.Y.

[73] Assignee: Color Access, Inc., Melville, N.Y.

[21] Appl. No.: 09/145,086

[22] Filed: Sep. 2, 1998

[51] Int. Cl.[7] ..... B01F 07/02

[52] U.S. Cl. ..... 366/281; 366/331

[58] Field of Search ..... 366/65, 96–98, 366/102, 242–251, 261–265, 270, 281–284, 331, 347, 349; 248/346.06, 346.07, 298.1, 286.1

[56] References Cited

U.S. PATENT DOCUMENTS

| | | |
|---|---|---|
| 2,311,586 | 2/1943 | Tyler . |
| 2,625,720 | 1/1953 | Ross . |
| 4,072,297 | 2/1978 | de Vries . |
| 4,683,381 | 7/1987 | Dufoug . |
| 4,808,040 | 2/1989 | Lisi . |
| 4,854,719 | 8/1989 | Sukup . |
| 4,889,432 | 12/1989 | Patterson . |
| 5,618,107 | 4/1997 | Bartsch . |

OTHER PUBLICATIONS

Indco Catalog, No. 179, Jul.–Dec. 1997, pp. 10, 11, 22, 24, 26, 32, 33, 34, 49, 50 and 51.

*Primary Examiner*—Joseph W. Drodge
*Assistant Examiner*—Als Schwartz
*Attorney, Agent, or Firm*—Kenyon & Kenyon

[57] ABSTRACT

This invention is a mixer mounting system which comprises a pair of horizontal guide bars, a collar slidably mounted on each bar, and a bracket pivotally mounted between the collars. A mixer is then attached to the bracket. The pivoting of the bracket permits the mixer to assume alternate positions, so as to be included in the mixing vessel when mixing is desired, or to be removed from the mixing vessel when mixing is complete, and/or when the vessel is to be cleaned.

13 Claims, 4 Drawing Sheets

MIXER MOUNTING SYSTEM

FIELD OF THE INVENTION

The present invention relates to a mixer mounting system, more particularly, it relates to a mixer mounting system which allows the mixer to be included in, or omitted from, a mixing vessel.

BACKGROUND OF THE INVENTION

When mixing a batch of liquids or powders within a mixing vessel it is often advantageous to mix the ingredients directly within one vessel. To accomplish this, a mixer needs to be introduced into the vessel along with the ingredients to be mixed.

Various systems have been used to introduce a mixer within a vessel. One such system is where the mixer is fix mounted to the mixing vessel. This system provides for sufficient mixing of the ingredients, but when the mixed ingredients need to be removed from the vessel the mixer is inconveniently in the way. This system also presents a problem when the vessel and the mixer need to be cleaned. Because the mixer is fixed in place, it is difficult for the operator to reach the intricate parts of the mixer, thus making a thorough cleaning very difficult, time consuming, and with certain products, nearly impossible. Also, the permanent mounting does not readily allow different types of mixers to be used with the same mixing vessel. Thus, when multiple types of mixing are required, the bulk has to be removed and placed in another mixing vessel.

To alleviate some of the drawbacks encountered from a permanently mounted mixer, some mounting systems allow a mixer to be clamped to the mixing vessel itself, and are therefore removable when the mixing is completed. The limitations associated with this type of system are readily apparent. Namely, the size of the motors used are limited to those which can be lifted easily by a human. The size of the motors are also limited by the clamping mechanism employed and the ability of the vessel to support that motor. Also, since the motor is placed on and removed from the vessel by hand, this system is extremely labor intensive.

Another system currently used is a vertical mounting system. With this system, the mixer is slidably mounted to a vertical shaft. To introduce the mixer into the vessel, the mixer is lowered by the operator directly into the vessel. The lowering of the mixer can be accomplished either manually, with the aid of a motor, or pneumatically.

The limitations to the manually operated system are similar to those encountered with the clamping system, i.e., the strength of the human operator limits the size of the mixer that can be used. When the mixers are larger, a motor or a pneumatic lift can be used to raise and lower the mixer. The drawbacks to the motorized and the pneumatic lifts are that they contain a significant number of moving parts which are difficult to keep clean, and which require constant maintenance of not only the mixer, but the device used to raise and lower the mixer.

Also, when larger vessels are used for mixing, the length of the mixing shaft increases. This larger shaft is needed in order to properly locate the mixing head within the vessel during mixing. With the increase in the length of the mixing shaft, the distance required to remove the mixer from the vessel also increases. Thus, larger mixers with longer shafts require additional space about the mixing vessel so that the mixer can be easily removed from the vessel, and therefore take up more space than smaller mixers.

This invention provides a mixer mounting system which allows a mixer to be included in, or omitted from, a batch.

This invention further provides a mixer mounting system which minimizes moving parts and potential contamination.

Also, this invention provides a mixer mounting system which is simple for an operator to use.

Further, this invention provides a mixer mounting system which allows different size and style mixers to be interchanged with one mounting system.

SUMMARY OF THE INVENTION

This invention is a mixer mounting system which comprises a pair of horizontal guide bars, a collar slidably mounted on each bar, and a bracket pivotally mounted between the collars. A mixer is then attached to the bracket. The pivoting of the bracket permits the mixer to assume alternate positions, so as to be included in the mixing vessel when mixing is desired, or to be removed from the mixing vessel when mixing is complete, and/or when the vessel is to be cleaned.

BRIEF DESCRIPTION OF THE DRAWINGS

Further objects, features and drawings of the present invention will better be understood in light of the embodiment examples which are discussed below with the aid of a drawing wherein.

DETAILED DESCRIPTION OF THE INVENTION

Figure 1:
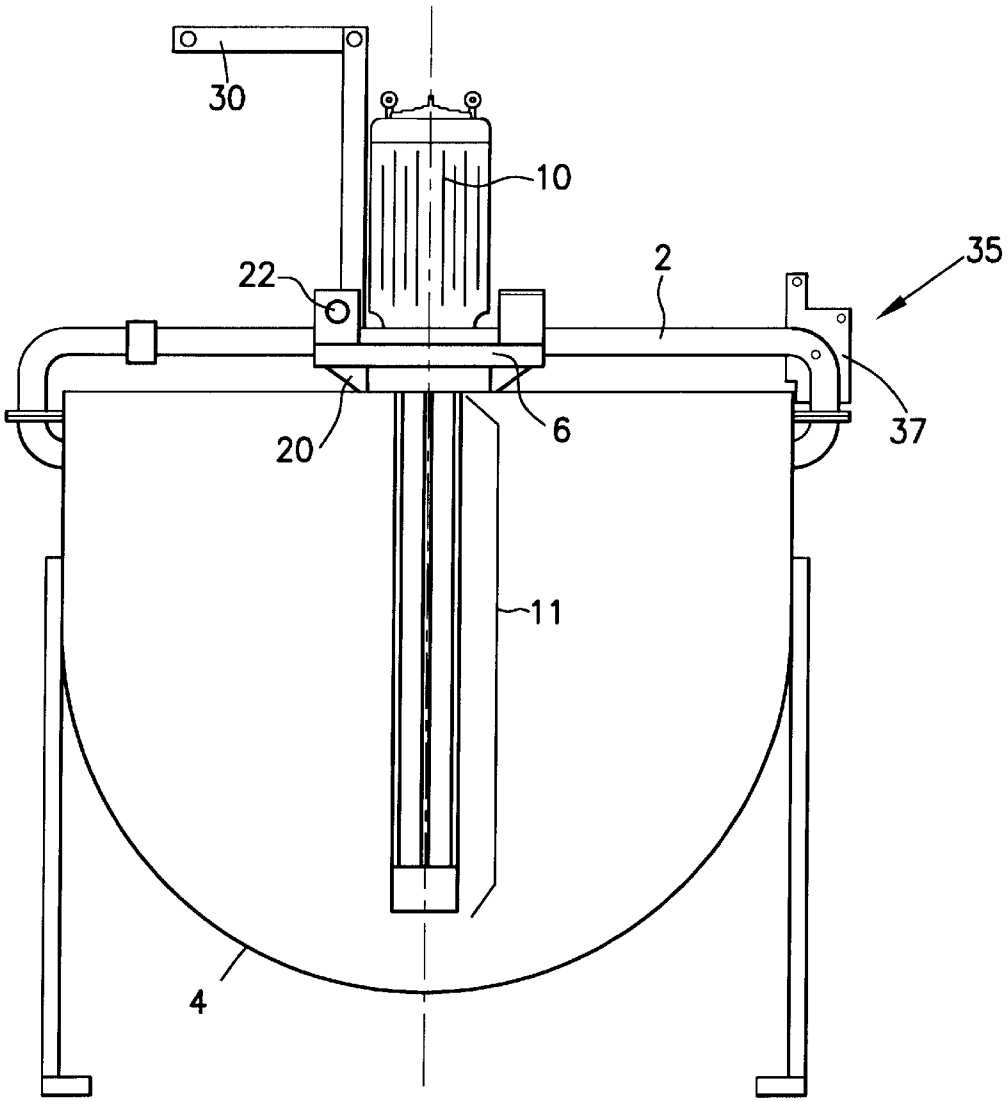
FIG. 1 is a side view of a mixer which has been pivoted for introduction into the mixing vessel.

Referring to FIG. 1, the mixer mounting system comprises a mixing vessel 4, a pair of horizontal guide bars 2, a collar 6 mounted to each guide bar 2, and a bracket 20 pivotally mounted between the collars 6.

Preferably, the mixing vessel 4 is an open top mixing vessel wherein the opening has a diameter of sufficient size to allow a mixer to be placed in and removed from the vessel. The diameter of the opening can be various sizes and will depend upon such variances as, for example, the size of the mixer motor, the length of the mixing shaft, etc., such variables being known within the art.

The guide bars 2 are mounted so as to be positioned above the mixing vessel 4, and parallel to each other. The bars 2 can be mounted directly to the mixing vessel 4, or they can be mounted to a roll-away frame (not shown), which in turn can be placed over the mixing vessel 4. The cross-sectional shape of the bars 2 is not critical, but it is preferred that the bars be substantially round in shape.

The bars 2 can be composed of steel, iron, aluminum, or any other material having a sufficient strength to support the system. Preferably the bars are composed of stainless steel, and have a smooth outer finish. Most preferably, the stainless steel used is grade 304 or better, and the finish is #4 or smoother.

A collar 6 is slidably mounted to each guide bar 2. It is important that the collars 6 be slidably mounted on the bars 2 so that, as a mixer 10 is pivoted, the collars 6 can be slid in a direction which will not allow the mixer 10 to contact the walls of the mixing vessel 4. For example, if the mixer 10 is allowed to remain centered in the mixing vessel 4 when the mixer 10 is pivoted (see FIGS. 1 and 3), the stirring end 11 of the mixer 10 could contact the wall of the mixing vessel 4, thus causing damage to the mixer 10 and/or the vessel 4. This possible contact of the mixer 10 and the vessel 4 will depend on the length of the stirring end 11 of the mixer 10 and the size of the vessel 4. To eliminate this potential problem, the collars 6 of the present invention operate to slide the mixer 10 as it is being pivoted (see FIG. 2), thereby eliminating the contact between the stirring end 11 of the mixer 10 and the wall of the mixing vessel 4.

Figure 4:
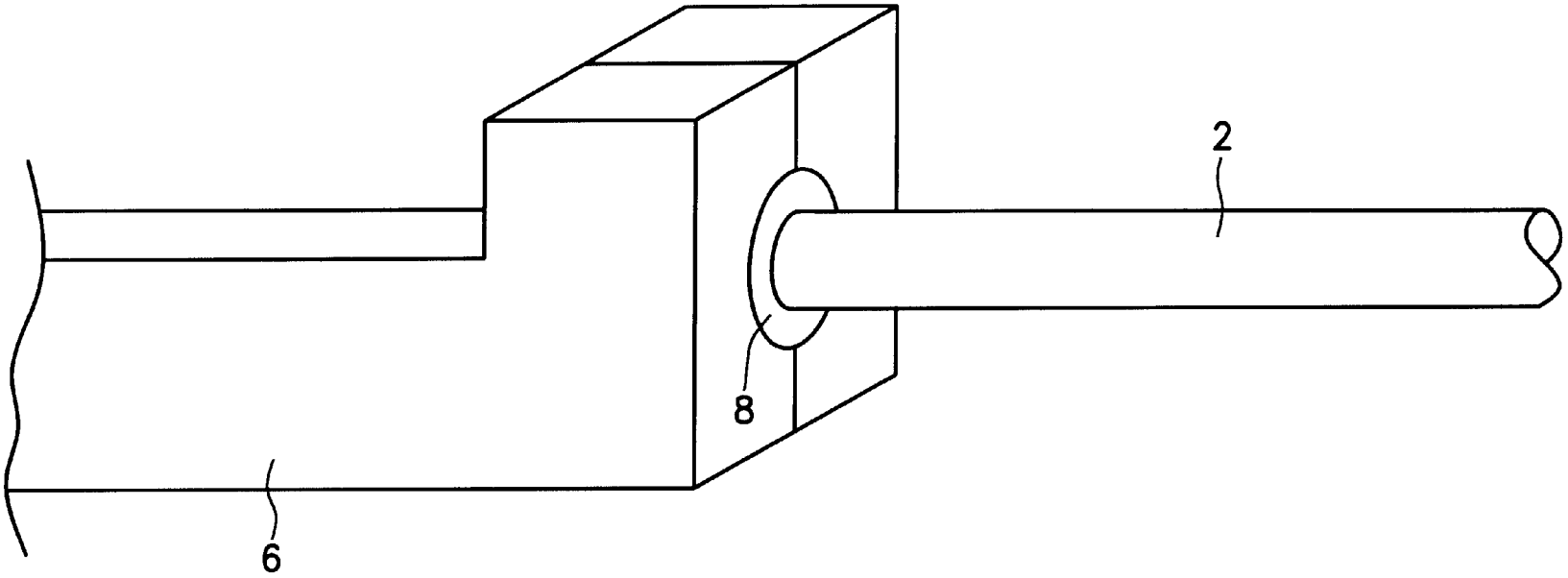
FIG. 4 is a fragmentary side elevational view of a collar having a bushing.

The collar 6 is preferably of the split-sleeve style, and composed of stainless steel. At the interface between the bars 2 and the collar 6, the collar 6 may be fitted with a bushing 8 to reduce frictional forces experienced as the collars 6 are slid along the length of the bars 2 (see FIG. 4). The bushing 8 can be composed of polyethylene, polypropylene, nylon, fluorinated polymers such as polytetrafluoro ethylene, phenolic, silicone, or like materials. As an alternative to the bushing, the collar can be provided with bearings at the interface between the bars and the collar.

A bracket 20 is then pivotally mounted between the collars 6. The bracket 20 is mounted so as to pivot about a horizontal axis 22, said axis being perpendicular to the horizontal guide bars 2. Preferably, the bracket is composed of stainless steel.

The mixer 10 is then attached to the bracket 20. The mixer 10 is attached to the bracket 20 so that, as the bracket 20 is pivoted about an axis 22, the mixer 10 is introduced into, or removed from, the mixing vessel 4. The mounting system can be used, or modified for use, with any type or any size (horsepower) mixers, such as electric motor mixers, air powered mixers, or the like. Also, the mounting system can be used with various style mixers, such as high flow mixers, high sheer mixers, homogenizers, or the like.

To assist with the pivoting of the bracket 20 and mixer 10 about the axis 22, a handle 30 can be provided. This handle 30 is preferably positioned at the axis 22 of the bracket 20 and extends upwardly therefrom. The positioning of the handle 30 in this manner will provide the operator with the needed leverage to easily pivot the mixer 10. The positioning of the handle 30 in this manner will also allow different mixers to be removed and mounted on the bracket 20 without interference from the handle 30.

Figure 2:
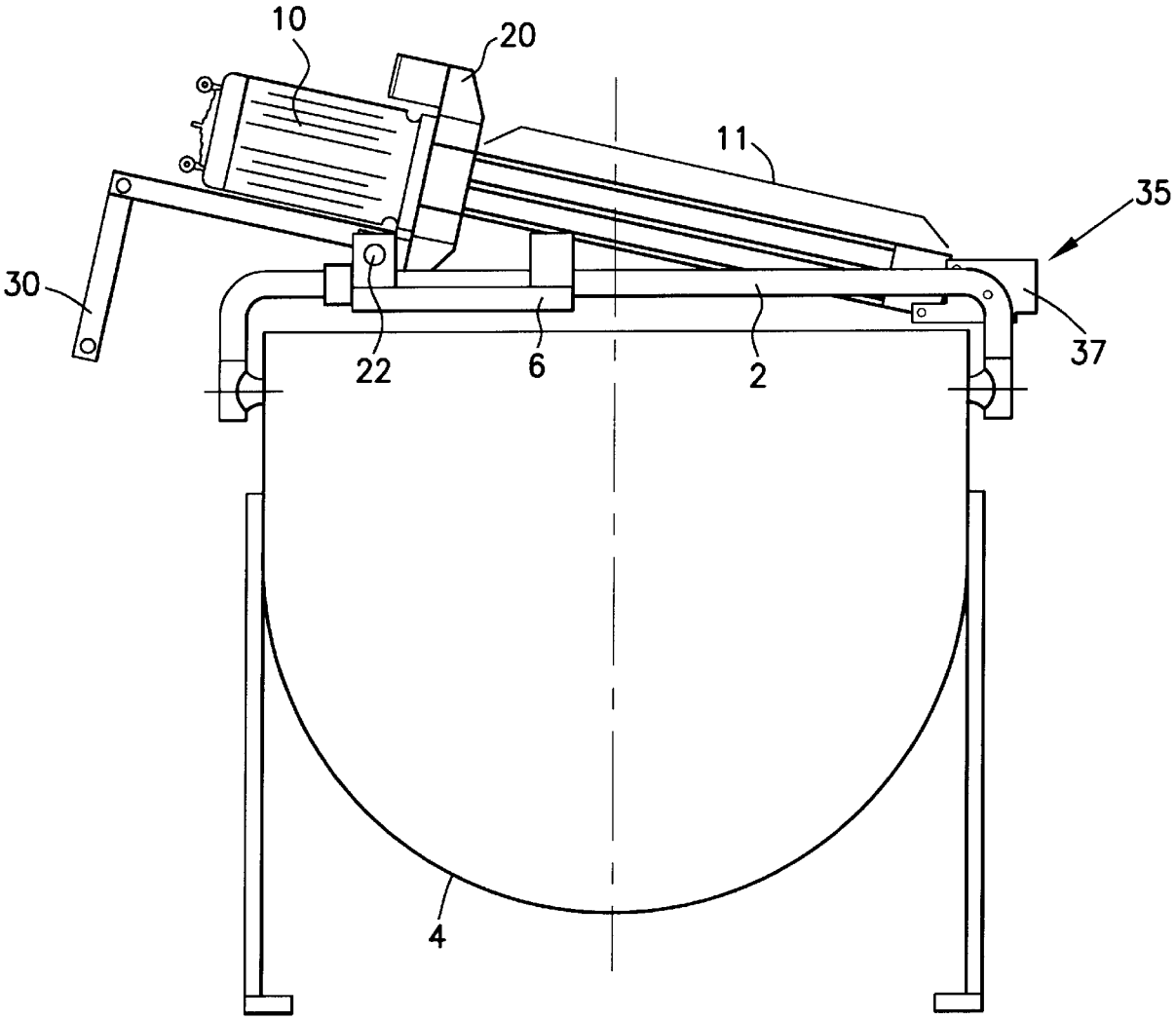
FIG. 2 is a side view of the mixer of FIG. 1, wherein the mixer has been pivoted for omission from the mixing vessel.

To retain the mixer 10 above the mixing vessel 4 after the mixer 10 is pivoted about the axis 22, a rest 35 is provided. The rest 35 is located between the guide bars 2 and opposite the horizontal axis 22 of the bracket 20. As seen in FIG. 2, the rest 35 acts to support the mixer 10 by allowing the stirring end 11 of the mixer 10 to be placed upon the rest 35, thus keeping the mixer 10 from re-entering the mixing vessel 4 after it has been pivoted.

Figure 3:
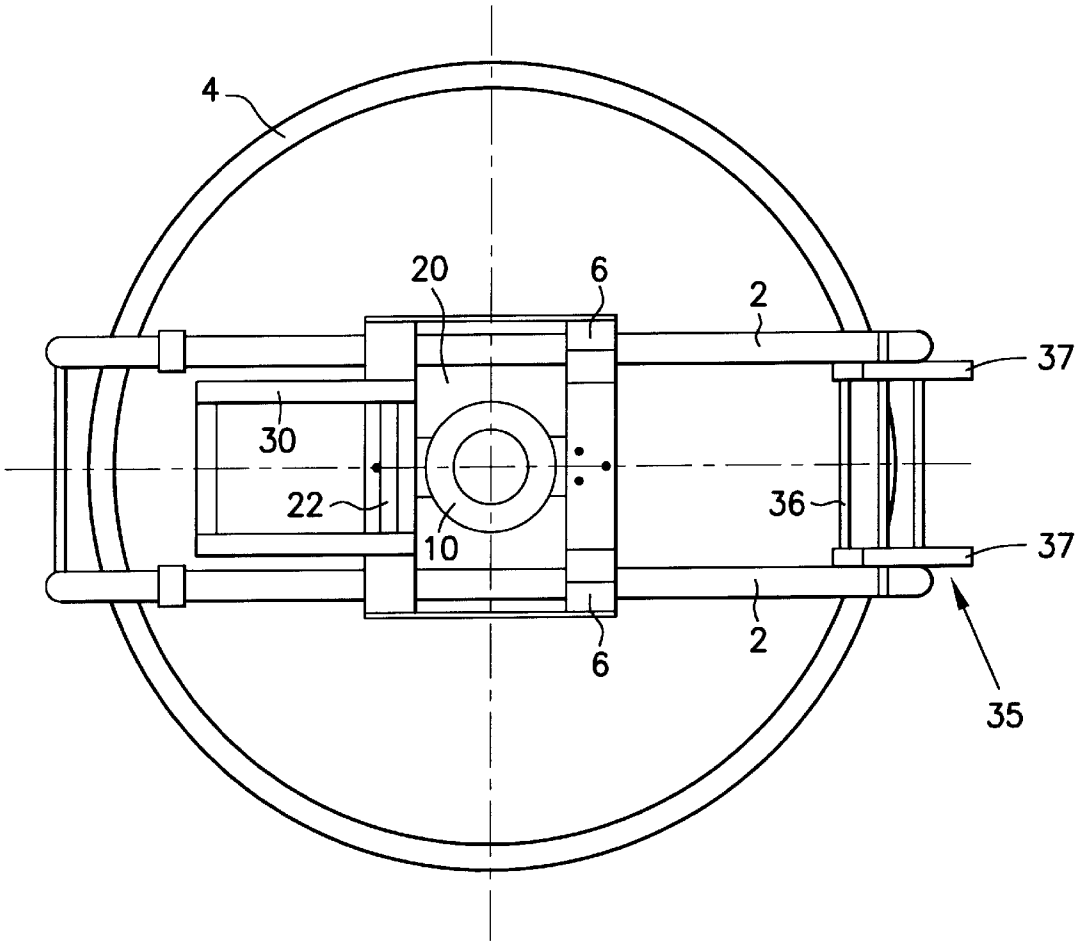
FIG. 3 is top view of the mixer of FIG. 1.

The rest 35 is generally designed as a post 36 which extends between the guide bars 2. The post 36 can be attached directly to the guide bars 2 (not shown), or can be designed to pivot between a first up position and a second down position. To allow the post 36 to pivot between first and a second position, the post 36 can be attached to a frame 37, wherein said frame 37 is pivotally mounted to the guide bars 2, as seen in FIG. 3. The frame 37 is designed so that when it is in the up position (FIG. 1), the post 36 will not interfere with the mixer 10 as it is introduced into, or removed from, the mixing vessel 4. When the frame 37 is in the down position (FIG. 2), the post 36 will be in a position to support the stirring end 11 of the mixer 10, thus not allowing the mixer 10 to pivot under its own weight and return into the mixing vessel 4.

The invention, and its broader aspects, is not limited to the specific details shown and described; rather, various modifications will be suggested to one skilled in the art, all of which are within the scope of this invention.

What is claimed is:

1. The mixer mounting system which comprises:

an open top mixing vessel;

a pair of horizontal guide bars attached to the mixing vessel;

a first collar slidably mounted about one of the pair of guide bars and a second collar slidably mounted about the other of the guide bars;

each of said collars having a bushing located at the interface between said bars and said collars which contacts the respective one of the pair of guide bars on which said collar is mounted;

a bracket pivotally attached to the first collar and the second collar along a horizontal axis that is perpendicular to the pair of guide bars;

a mixer attached to the bracket; and a rest constructed and arranged to support the mixer when removed from the vessel so as not to allow the mixer to return to the vessel under its own weight.

2. The mixer mounting system as in claim 1 wherein the rest is located between the guide bars.

3. The mixer mounting system as in claim 2 wherein the rest is a post which extends between the guide bars.

4. The mixer mounting system as in claim 2 wherein the rest is a post which pivots between a first up position and a second down position.

5. The mixer mounting system as in claim 1 wherein at least one of the first collar and the second collar is a split-sleeve collar.

6. The mixer mounting system as in claim 5 wherein a material comprising the bushing is selected from the group consisting of polyethylene, polypropylene, nylon, polytetrafluoro ethylene, phenolic and silicone.

7. The mixer mounting system as in claim 1 wherein a handle is positioned on the bracket and extends upwardly therefrom.

8. The mixing system which comprises:

an open top mixing vessel;

a pair of horizontal guide bars attached to the mixing vessel;

a first split-sleeve collar slidably mounted about one of the pair of guide bars and a second split-sleeve collar slidably mounted about the other of the pair of guide bars;

each of said collars having a bushing located at the interface between said bars and said collars which contacts the respective one of the pair of guide bars on which said collar is mounted;

a bracket pivotally attached to the first collar and the second collar along a horizontal axis, said axis being perpendicular to the pair of horizontal guide bars;

a mixer attached to the bracket; and a rest constructed and arranged to support the mixer when removed from the vessel so as not to allow the mixer to return to the vessel under its own weight.

9. The mixing system as in claim 8 wherein the rest is located between the guide bars.

10. The mixing system as in claim 9 wherein the rest is a post which extends between the guide bars.

11. The mixing system as in claim 9 wherein the rest is a post which pivots between a first up position and a second down position.

12. The mixing system as in claim 8 wherein a material comprising the bushing is selected from the group consisting of polyethylene, polypropylene, nylon, polytetrafluoro ethylene, phenolic and silicone.

13. The mixing system as in claim 8 wherein a handle is positioned at the horizontal axis of the bracket and extends upwardly therefrom.

* * * * *